US006892810B2

(12) United States Patent
Austbo et al.

(10) Patent No.: US 6,892,810 B2
(45) Date of Patent: May 17, 2005

(54) GRIPPER BLOCK FOR COILED TUBING INJECTOR WITH VARIABLE TUBING SIZE CAPABILITY

(75) Inventors: Larry L. Austbo, Duncan, OK (US); Joshua N. Andersen, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 62 days.

(21) Appl. No.: 10/396,877

(22) Filed: Mar. 25, 2003

(65) Prior Publication Data

US 2004/0188100 A1 Sep. 30, 2004

(51) Int. Cl.[7] ..... E21B 19/24
(52) U.S. Cl. ..... 166/85.5; 166/77.3; 226/173
(58) Field of Search ..... 166/77.1–77.3, 166/85.5, 381; 226/172, 173

(56) References Cited

U.S. PATENT DOCUMENTS 5,094,340 A 3/1992 Avakov ..... 198/626.1
5,309,990 A * 5/1994 Lance ..... 166/77.3
5,553,668 A 9/1996 Council et al. ..... 166/77.3
5,853,118 A 12/1998 Avakov ..... 226/173
6,173,769 B1 1/2001 Goode ..... 166/77.3
6,230,955 B1 5/2001 Parks ..... 226/190
6,367,557 B1 4/2002 Rosine et al. ..... 166/384

* cited by examiner

*Primary Examiner*—Zakiya Walker
(74) *Attorney, Agent, or Firm*—John W. Wustenberg; Rodney B. Carroll

(57) ABSTRACT

An improved V-style gripper block to better accommodate a variable outer diameter material (e.g. cable, plastic, wire, or pipe). The gripper block comprises a block body being connectable to a gripper chain in an injector apparatus, a gripper plate having arcuate and/or angled gripping surfaces for engaging tubing of various outer diameters, and a flex layer disposed between the gripper plate and the block body to allow the gripping surface of the gripper plate to move relative to the block body to which it is attached. This relative movement allows the gripping surface of the gripper block to rapidly conform to changes in the outer diameter of coiled tubing. In various embodiments, the flex layer may be formed of elastomeric materials including natural or synthetic rubber; an encapsulated gel or liquid within a flexible membrane; or mechanical means such as springs.

15 Claims, 2 Drawing Sheets

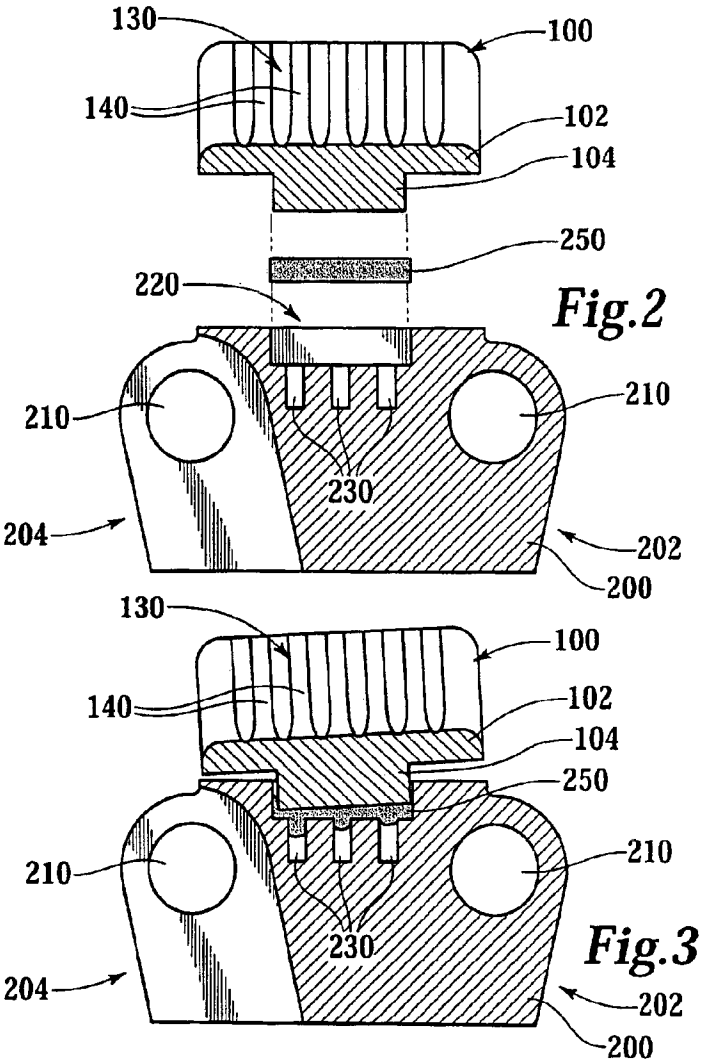
Fig.2
Fig.3
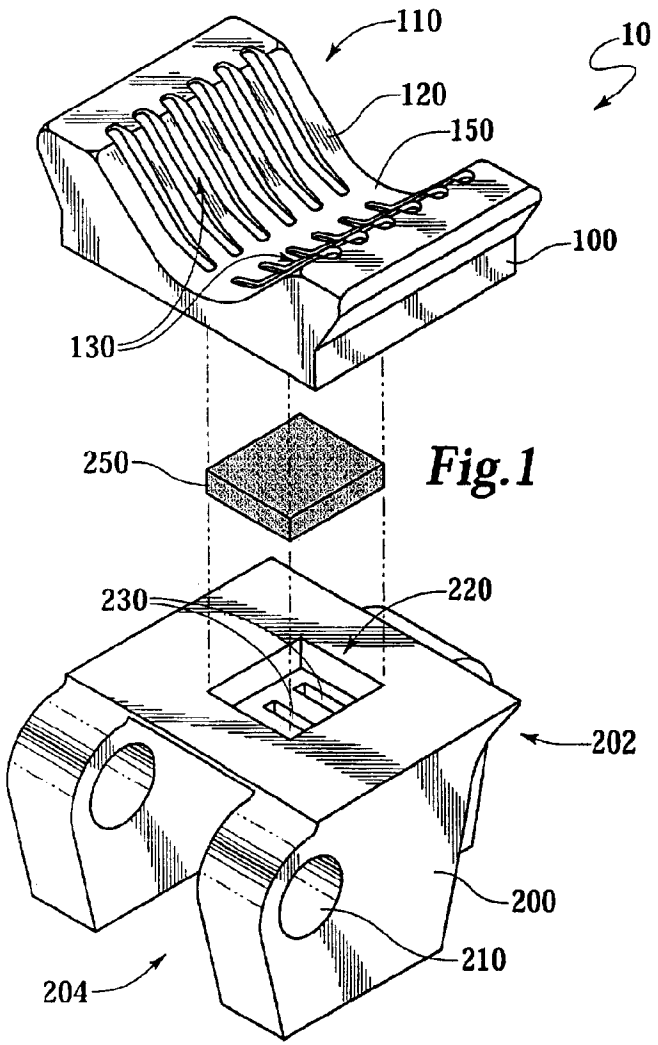
Fig.1

GRIPPER BLOCK FOR COILED TUBING INJECTOR WITH VARIABLE TUBING SIZE CAPABILITY

BACKGROUND

The present invention relates to gripper blocks installed in coiled tubing injection equipment used in the oil and gas production industry. More specifically, the present invention relates to a gripper block designed to better accommodate lengths of coiled tubing with varying outside diameters.

Reeled or coiled tubing has been used for many years for performing certain downhole operations, including but not limited to completions, washing, circulating, production, production enhancement, cementing, inspecting, and logging. There are a number of patents issued on coiled tubing injectors and related equipment. Such injectors generally use a pair of opposed endless gripper chains mounted in a common plane. The gripper chains are normally made up of links, rollers, and gripper blocks. Opposed gripper blocks on the endless chains engage the tubing as to firmly grasp the tubing in such a way that the gripper blocks will force the tubing into or out of a wellbore when the gripper chains are driven. Upon setting the gripper chains into motion and upon each opposing pair of gripper blocks releasing their hold on the tubing, another pair of opposed gripper blocks grippingly engage the tubing and the cycle continues until a desired amount of tubing has been inserted into or withdrawn from the wellbore, or until the gripper chains are no longer driven.

Over the years, a variety of gripper blocks have been developed to improve the performance of coiled tubing injector units. Such improvements include designs directed to increasing the load carrying capability of gripper blocks, thus eliminating or limiting scarring and distortion of the tubing caused by gripper block engagement; providing the ability to accommodate differing tubing diameters without having to change gripper blocks; reducing the weight of gripper blocks; and reducing the manufacturing costs of gripper blocks. Such prior art gripper blocks are disclosed in U.S. Pat. No. 5,094,340 to Avakov, issued Mar. 10, 1992; U.S. Pat. No. 5,853,118 to Avakov, issued Dec. 29, 1998; and U.S. Pat. No. 6,230,955 B1 to Parks, issued May 15, 2001; each of these patents being assigned to the assignee of the present invention and the details of each of these patents being incorporated herein in its entirety by reference.

In the past, coiled tubing has had a constant cross section. However, maintaining a constant diameter for the tubing can present some problems under certain circumstances. For example, it may be desirable to reduce the weight of the string or to reduce the amount of drag in the wellbore by reducing the diameter of the tubing. Additionally, small diameter tubing is preferable if the size at the treatment area is particularly small or confined. However, it is also noted that smaller diameter tubing tends to buckle more readily than large diameter tubing and that smaller diameter tubing also presents significant pressure drop problems in longer tubing strings. It is notable that each of these problems with both large and small constant diameter tubing may be addressed by allowing the use of larger outside diameter tubing at the top of the string and a smaller outside diameter tubing at the bottom of the string proximate to the treatment zone. One convenient way of linking or connecting coiled tubing having varying outside diameters utilizes one or more tapered connectors in the tubing string. Such a tapered connector generally comprises at least a first tubular portion having a first tubing outside diameter, a second tubular portion having a second tubing outside diameter which is different than the first, and a tapered portion disposed between the first and second tubing portions. One such tapered connector for a tubing string is disclosed in U.S. Pat. No. 6,367,557 B1 to Rosine et al., issued Apr. 9, 2002; this patent being assigned to the assignee of the present invention and the details of this patent being incorporated herein in its entirety by reference.

The tapered connector, according to Rosine et al., and the improved gripper block designs, according to Avakov and Parks, make it possible to insert coiled tubing into a well using a twin carriage coiled tubing injector apparatus as known in the art. One example of a twin carriage tubing injector apparatus is shown in U.S. Pat. No. 5,553,668 to Council et al., issued Sep. 10, 1996; this patent being assigned to the assignee of the present invention and the details of this patent being incorporated herein in its entirety by reference. Although it is possible to stop the injector apparatus to adjust the spacing between the moveable gripper chains to accommodate varying outer tube diameters, it would be desirable to have an improved gripper block to accommodate abrupt changes in the outer diameter of jointed tubulars and tapered strings without costly stoppages to make adjustments or modifications. Accordingly, there is a need for an improved gripper block capable of not only engaging the surfaces of tubing having changing outer diameters but to conform rapidly to these changing geometries and reduce the number of stoppages for adjustment or modification required in standard twin carriage tubing injector apparatus.

SUMMARY

The gripper block of the present invention will address these needs and provide other desirable properties by creating modified V-style gripper blocks that quickly conform to variable outer diameter elongated objects (e.g. cable, plastic, wire, or pipe). This may be accomplished by designing a V-style gripper block comprising a block body being connectable to a gripper chain in an injector apparatus, a gripper plate having arcuate and/or angled gripping surfaces for engaging tubing of various outer diameters, and a flex layer of elastomeric material disposed between the gripper plate and the block body to allow a gripping surface of the gripper block to move relative to the block body to which it is attached. This relative movement allows the gripping surface of the gripper block to rapidly conform to a changes in the outer diameter of coiled tubing. It is believed that a gripper block that rapidly conforms to changes in diameter will be less likely to bind, crimp, or damage the coiled tubing and will also be able to better accommodate fittings, including tapered connectors.

The elastomeric material located between the gripper plate and the block body is strategically placed within the gripper block to allow the gripping surface to move without damage to the tubular material. In one embodiment the elastomeric materials may be of various polymeric compounds or blends including natural or synthetic rubber. Moreover, it is also possible to encapsulate a gel or liquid within a flexible membrane to achieve the same function of the elastomeric material. In yet another embodiment, the function of the elastomeric material may be achieved through various mechanical means, such as springs which extend between the block body and the gripper plate and allow the gripper plate to move relative to the block body as the outer diameter of the flexible tubing changes.

It is believed that a gripper block constructed in accordance with the present invention will allow operators to run tubulars having changing outer diameters without interruption. Specifically, a gripper block constructed in accordance with the present invention will allow twin carriage tubing injectors as known in the art to accommodate abrupt changes in outer diameter, joint tubulars, and tapered strings without costly adjustments or modifications.

BRIEF DESCRIPTION OF THE DRAWINGS

The present invention will be better understood in view of the detailed description in conjunction with the following drawings in which like reference numbers refer to like parts in each of the figures and in which:

FIG. 1 is an exploded perspective view of a first embodiment of a gripper block with a cushion flex layer constructed in accordance with the present invention;

FIG. 2 is an exploded cross-sectional view of the gripper block with a cushion flex layer as shown in FIG. 1;

FIG. 3 is an assembled cross-sectional view of the gripper block with a cushion flex layer as shown in FIG. 1;

DETAILED DESCRIPTION

Figure 5:
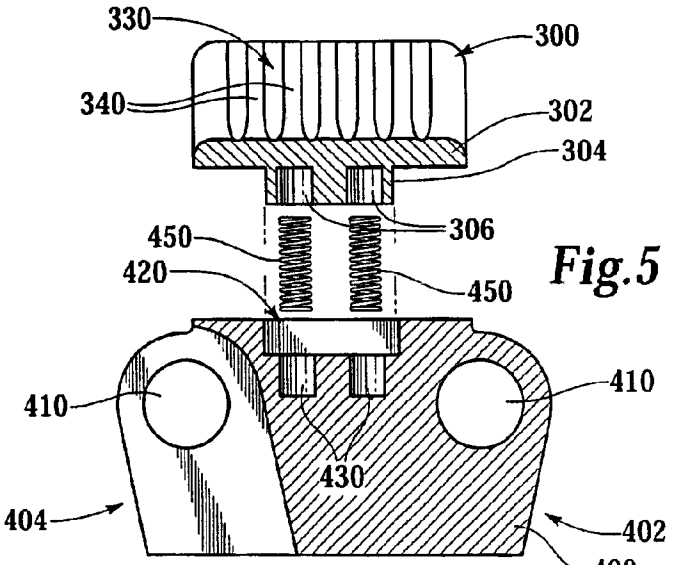
FIG. 5 is an exploded cross-sectional view of the gripper block with a spring flex layer as shown in FIG. 4.

Referring now to FIGS. 1–3, a first embodiment of a gripper block 10 constructed in accordance with the present invention is shown. As best seen in FIG. 1, viewed along the longitudinal axis, the upper portion of a gripper plate 100 features a generally V-shaped channel 110 adapted to receive, for example, elongated objects such as coiled tubing. The topmost portion of the gripper plate 100 has a gripping portion 120 for engaging elongated objects. The gripping portion 120 further comprises a pair of opposed gripping surfaces 130 extending perpendicularly from the longitudinal axis. The opposed gripping surfaces 130 are generally inclined or slanted inward toward each other and form an angle of not greater than about 120°. In one embodiment, the opposed gripping surfaces 130 may be inclined at about 90° to each other. The opposed gripping surfaces 130 further feature a series of ridges 140 formed by alternating crests and roots. The ridges 140 permit the opposed gripping surfaces 130 to better engage the surface of coiled tubing as it is moved into or out of a wellbore. Note that the generally V-shaped profile of the gripper plate 100 is well suited to accommodate coiled tubing and other elongated objects having varying outer diameters.

Still referring to FIGS. 1–3, it is also possible to incorporate a curved gripping surface 150 into the gripping portion 120 of the gripper plate 100. The curved gripping surface 150 may further comprise ridges, not shown, formed by alternating crests and roots. In one embodiment, the curved gripping surface 150 has a particular radius of curvature designed to accommodate an elongated object having a predetermined minimum outer diameter. For objects exceeding this particular outer diameter, the opposed gripping surfaces 130 will come into play and allow the gripper plate 100 to engage the object. In most embodiments, the radius of curvature for the curved gripping surface 150 should sweep and angle of not more than about 150°. The use of both curved gripping surface 150 and opposed gripping surfaces 130 allow for the gripper plate 100 to achieve better fit and conformity with the elongated object. In yet another embodiment, the opposed gripping surfaces 130 may extend outwardly from the endpoints of the curved gripping surface 150 to form ridges having a rather unique V-shape with a rounded bottom. This particular ridge design for the gripping portion 120 of the gripper block 10 is set forth and described in greater detail in U.S. Pat. No. 6,230,955 B1 to Parks.

Referring now to FIG. 2, a cross-sectional view of the gripper plate 100 is shown. The gripper plate 100 is usually constructed by casting, forging, or machining a single metal ingot formed of steel, titanium, or other suitable metal alloys. Note that the gripper plate 100 is shown to have an upper portion 102 with a generally V-shaped profile when viewed along the longitudinal axis and a lower portion 104 which is generally more box-like in shape and adapted to fit into an opening or recess 220 in the upper portion of block body 200. It is understood that, although a box-like lower portion 104 is shown as fitted into a rectangular recess 220, a number of alternative shapes and geometries may be used such as fitting a hemispherical lower portion into a cup-like recess. Again, the ridges 140 formed of alternating crests and roots that comprise the opposed gripping surfaces 130 of the gripper plate 100 are clearly visible.

Referring still to FIGS. 1–3, one embodiment of the block body 200 adapted to support the gripper plate 100 will be set forth and described. As shown here, the block body 200 has a form of tongue and groove design which allows the gripper blocks 10 to be connected end-to-end. By linking a number of these gripper blocks 10 together in series, it is possible to form a caterpillar-like chain which may be used as a gripper chain in a device for moving elongated objects, including coiled tubing, suitable for use in oil and gas applications. Although it is to be understood that the block bodies 200 may have any number of embodiments and be connected together in a number of different ways, this particular design allows the block bodies 200 to be easily fitted together and held one to another by two pins, not shown. The pins are fitted through openings 210 which extend laterally or transversally across the block body 200 near leading edge 202 and trailing edge 204 of the block body 200. As with the gripper plate 100, the block body 200 is generally formed of a single metal ingot which is cast, forged, or machined of steel, titanium, or other suitable metal alloys.

Referring still to FIGS. 2–3, a cross-section of the block body 200 is shown. The cross-sectional views permit a better look at the details of the generally rectangular recess 220 located in the central top portion of the block body 200. The recess 220, as shown here, features three smaller recesses or slots 230 extending downward into the block body 200. Of course, the number and geometry of the slots 230 may be varied to suit differing applications or to address particular needs.

In use, the gripper plate 100 may be fitted into the recess 220 on the block body 200 and multiple block bodies 200 may be linked together by fitting pins through the openings 210 to form a gripper chain. However, in accordance with the present invention, the gripper block 10 will further comprise a flex layer 250 disposed between the block body 200 and the gripper plate 100. In one embodiment, the flex layer 250 may be a polymeric elastomer such as rubber or the like which is fitted into the recess 220 on the top of the block body 200 prior to attaching the gripper plate 100. This layer of rubber or elastomer may be about 5 to about 20 millimeters thick and will usually allow the gripper plate 100 to flex or move relative to the block body 200 in use. Of course, the amount of relative movement between the gripper plate 100 and the block body 200 and the amount of force required to induce this movement may be varied by controlling the mechanical properties and the choice of material used to create the flex layer 250.

Typically, it is desirable to facilitate a relative movement between the gripper plate 100 and the block body of up to about 10 millimeters in any one direction. Although the magnitude of this movement would appear to be quite small, it is believed that this should be sufficient to reduce crimping or damaging coiled tubing as it varies in diameter and also to better accommodate fittings such as tapered connectors. As best seen in FIG. 3, the slots 230 at the bottom of the recess 220 formed in the block body 200 serve to provide voids into which the flex layer 250 may be forced or guided as loads are applied to the gripper plate 100. In FIG. 3, the gripper plate 100 is rocked or tilted away from its neutral or resting position to show deformation of the flex layer 250 and the movement of an elastomer or an encapsulated fluid into the slots 230.

In one embodiment, the flex layer 250 may actually serve to attach the gripper plate 100 to the block body 200 by selecting a polymeric adhesive compound having the requisite elastomeric properties, such as a natural or synthetic rubber based compound. It is noted that in various alternative embodiments it is possible to create a flex layer 250 with the desired elastomeric properties using a compressible or incompressible fluid which has been properly encapsulated. This may be carried out by disposing a layer of fluid between the gripper plate 100 and the block body 200 and then sealing it in place with a flexible seal about the perimeter of the gripper plate 100 and the recess 220 of the block body 200.

Another alternative embodiment would be to create a flex layer 250 by encapsulating a fluid that is substantially incompressible within a flexible polymer membrane to create a small flexible cushion. In use, as loading is applied to the gripper plate 100, it will tend to force the fluid into the slots 230 of the block body 200 thereby allowing the gripper plate 100 to flex or move slightly in any direction relative to the block body 200. As noted earlier, small movements of the gripper plate 100 permit the gripper block 10 to engage elongated objects such as coiled tubing and to adapt to changes in the diameter without damaging the elongated object as it is handled. In this particular embodiment, the gripper plate 100 essentially floats atop the encapsulated fluid cushion of the flex layer 250 and is allowed to rock slightly forward, backward, or side-to-side relative to the block body 200 to which it is attached.

Figure 6:
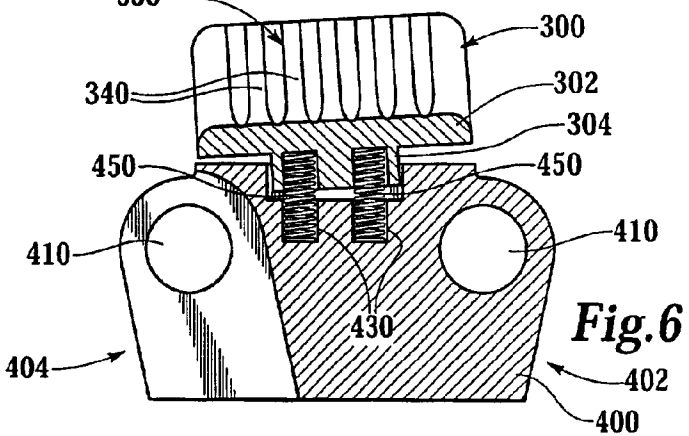
FIG. 6 is an assembled cross-sectional view of the gripper block with a spring flex layer as shown in FIG. 4.
Figure 4:
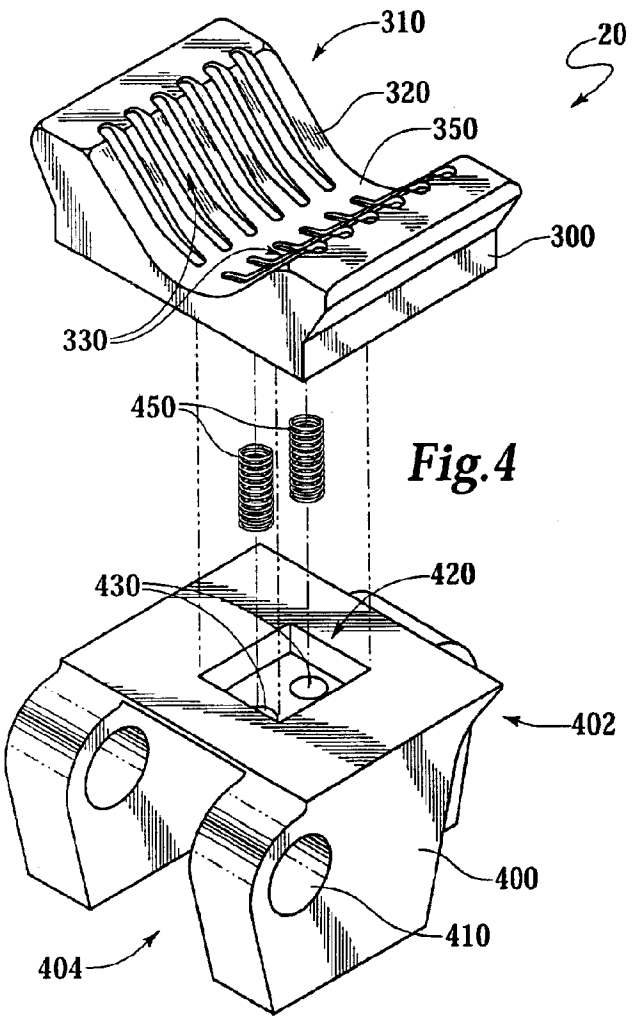
FIG. 4 is an exploded perspective view of a second embodiment of a gripper block with a spring flex layer constructed in accordance with the present invention.

Referring now to FIGS. 4–6, a gripper block 20 similar to that shown in FIGS. 1–3 has been modified for use in an alternative gripper block design. The gripper plate 300 has a generally V-shaped channel 310 when viewed along the longitudinal axis and has a gripping portion 320 further comprising a pair of opposed gripping surfaces 330 along its top surface. The pair of opposed gripping surfaces 330 are provided with a number of ridges 340 formed by alternating crests and roots. As before, the opposed gripping surfaces 330 are sloped or inclined toward each other at an angle of not greater that about 120°. Also, as noted above in regard to FIGS. 1–3, it is possible to have a curved gripping surface 350 to better accommodate small diameter elongated objects. In most embodiments, the curved gripping surface 350 will have a radius of curvature that sweeps though an angle of not more than about 150°.

As best seen in FIG. 5, the gripper plate 300 has an upper portion 302 for engaging elongated objects and a lower portion 304 having a generally rectangular box-like design to be fitted into a recess 420 on block body 400. However, in this particular embodiment, the gripper plate 300 has two cylindrical bores or openings 306 formed in its lower portion 304 and extend upward into the gripper plate 300. The openings 306 are intended to accommodate a pair of mechanical springs. Although shown here as a pair of cylindrical bores 306 intended to accommodate a pair of generally cylindrical coil springs 450, it is understood that a number of other mechanical solutions are possible involving various numbers and configurations of coil springs and the use of flat or leaf-type springs as well.

The block body 400 is similar to that shown in FIGS. 1–3, although the recess 420 in the block body 400 has been changed. The three slots or voids 230 which were previously intended to accommodate flowable liquids or movement of elastomeric materials have been removed and replaced by two cylindrical depressions or openings 430 extending downward into the block body 400. The openings 430 may be used to accommodate the pair of springs 450. The springs 450 serve to act as a functional equivalent to the flex layer 250 of various elastomeric materials or fluids described earlier in regard to the embodiments shown in FIGS. 1–3. The block body 400 has a form of tongue and groove design which allows the gripper blocks 20 to be connected end-to-end. By linking a number of these gripper blocks 20 together in series, it is possible to form a caterpillar-like chain which may be used as a gripper chain in a device for moving elongated objects, including coiled tubing, suitable for use in oil and gas applications. Although it is to be understood that the block bodies 400 may have any number of embodiments and be connected together in a number of different ways, this particular design allows the block bodies 400 to be easily fitted together and held one to another by two pins, not shown. The pins are fitted through openings 410 which extend laterally or transversally across the block body 400 near leading edge 402 and trailing edge 404 of the block body 400.

Similarly, the materials used and the stiffness of the springs 450 as well as other physical characteristics may be selected to provide sufficient stiffness to hold the gripper plate 300 in place atop the block body 400 yet, under the application of applied loads, allow the gripper plate 300 to move or deflect up to about 10 millimeters in any one direction. Although this amount of deflection seems rather small in magnitude, it is sufficient to allow the gripper plate 300 to deflect quickly and accommodate changing outer diameters in coiled tubing better than unitary prior art gripper blocks. It is believed that by incorporating the springs 450 it is possible to reduce crimping and other damage to coiled tubing and also better accommodate fittings such as tapered connectors. Additionally, it is believed that gripper blocks having a separate gripper plate and block body with a flex layer placed therebetween will also result in less stoppages to adjust gripper chains and tubing injector apparatus settings when varying diameter coiled tubing is used in oil and gas operations.

While a number of preferred embodiments of the invention have been shown and described herein, modifications may be made by one skilled in the art without departing from the spirit and the teachings of the invention. The embodiments described herein are exemplary only, and are not intended to be limiting. Many variations, combinations, and modifications of the invention disclosed herein are possible and are within the scope of the invention. Accordingly, the scope of protection is not limited by the description set out above, but is defined by the claims which follow, that scope including all equivalents of the subject matter of the claims.

What is claimed is:

1. A gripper block for use in a device for moving elongated objects, comprising:

a gripper plate;

a block body, wherein the gripper plate is adapted to move relative to the block body; and a flex layer comprising a natural rubber or a synthetic rubber disposed between the gripper plate and the block body to allow relative movement between the gripper plate and the block body.

2. A gripper block for use in a device for moving elongated objects, comprising:

a gripper plate;

a block body, wherein the gripper plate is adapted to move relative to the block body; and a flex layer comprising a fluid encapsulated within a flexible membrane disposed between the gripper plate and the block body to allow relative movement between the gripper plate and the block body.

3. The gripper block of claim 2 wherein the fluid is substantially incompressible.

4. A gripper block for use in a device for moving elongated objects, comprising:

a gripper plate;

a block body, wherein the gripper plate is adapted to move relative to the block body; and a spring disposed between the gripper plate and the block body to allow relative movement between the gripper plate and the block body.

5. A gripper block for use in a device for moving elongated objects, comprising:

a gripper plate comprising a pair of opposed gripping surfaces having ridges defined by alternating crests and roots; and a block body, wherein the gripper plate is adapted to move relative to the block body.

6. A gripper block for use in a gripper chain in a device for moving elongated objects, comprising:

a block body having a longitudinal axis, wherein the block body is adapted to be connected to the gripper chain such that the longitudinal axis is aligned lengthwise with the gripper chain;

a gripper plate comprising a pair of opposed gripping surfaces extending perpendicularly from the longitudinal axis of the block body for engaging the elongated objects, wherein the opposed gripping surfaces have ridges defined by alternating crests and roots; and a flex layer disposed between the gripper plate and the block body to allow the gripper plate to move relative to the block body.

7. The gripper block of claim 6 wherein the opposed gripping surfaces are sloped at an angle of not greater than about 120° from each other.

8. The gripper block of claim 6 wherein the opposed gripping surfaces are sloped at an angle of about 90° from each other.

9. The gripper block of claim 6 wherein the gripper plate further comprises a curved gripping surface.

10. The gripper block of claim 9 wherein a radius of curvature of the curved gripping surface extends from a first end to a second end through an angle of not greater than about 150°.

11. The gripper block of claim 9 wherein the curved gripping surface has outer ends and the pair of opposed gripping surfaces diverge from the outer ends of the curved gripping surface.

12. A gripper block for use in a gripper chain in a device for moving elongated objects, comprising:

a block body having a longitudinal axis, wherein the block body is adapted to be connected to the gripper chain such that the longitudinal axis is aligned lengthwise with the gripper chain;

a gripper plate for engaging the elongated objects, and a flex layer comprising a natural rubber or a synthetic rubber disposed between the gripper plate and the block body to allow the gripper plate to move relative to the block body.

13. A gripper block for use in a gripper chain in a device for moving elongated objects, comprising:

a block body having a longitudinal axis, wherein the block body is adapted to be connected to the gripper chain such that the longitudinal axis is aligned lengthwise with the gripper chain;

a gripper plate for engaging the elongated objects, and a flex layer comprising a fluid encapsulated within a flexible membrane disposed between the gripper plate and the block body to allow the gripper plate to move relative to the block body.

14. The gripper block of claim 13 wherein the fluid is substantially incompressible.

15. A gripper block for use in a gripper chain in a device for moving elongated objects, comprising:

a block body having a longitudinal axis, wherein the block body is adapted to be connected to the gripper chain such that the longitudinal axis is aligned lengthwise with the gripper chain;

a gripper plate for engaging the elongated objects, and a flex layer comprising a spring disposed between the gripper plate and the block body to allow the gripper plate to move relative to the block body.

* * * * *